US005738209A

United States Patent [19]

Burr et al.

[11] Patent Number: 5,738,209

[45] Date of Patent: Apr. 14, 1998

[54] CABLE STORAGE CONTAINER

[75] Inventors: Ronald Wayne Burr, Clinton, Miss.; James Patrick Calcagni, Canfield, Ohio

[73] Assignee: General Motors Corporation, Detroit, Mich.

[21] Appl. No.: 772,607

[22] Filed: Dec. 23, 1996

[51] Int. Cl.[6] ..... B65D 85/04; B65D 21/04

[52] U.S. Cl. ..... 206/397; 206/408; 206/508; 206/515; 206/702

[58] Field of Search ..... 206/389, 391, 206/397, 408, 409, 395, 503, 505, 508, 509, 702, 515; 242/129

[56] References Cited

U.S. PATENT DOCUMENTS

| | | | |
|---|---|---|---|
| Re. 30,727 | 9/1981 | Chong . | |
| 2,031,851 | 2/1936 | Plunkett | 206/408 X |
| 2,200,140 | 5/1940 | Willeke et al. . | |
| 2,869,719 | 1/1959 | Hubbard | 206/389 X |
| 2,943,732 | 7/1960 | Kovalesks et al. | 242/129 X |
| 3,218,002 | 11/1965 | Derrickson . | |
| 3,406,817 | 10/1968 | Lame et al. | 206/408 |
| 3,472,364 | 10/1969 | Sloan | 206/397 |
| 3,602,455 | 8/1971 | Lewis . | |
| 3,778,000 | 12/1973 | Breuner et al. . | |
| 3,819,847 | 6/1974 | Charles | 206/509 X |
| 3,831,879 | 8/1974 | Miller et al. | 242/129 |
| 4,015,795 | 4/1977 | Chong . | |
| 4,161,248 | 7/1979 | Kalmenovitoh | 206/389 |
| 4,248,391 | 2/1981 | Ness . | |
| 4,664,260 | 5/1987 | Stokes . | |
| 4,984,685 | 1/1991 | Douglas | 206/702 |
| 5,103,977 | 4/1992 | Douglas | 206/702 |
| 5,490,595 | 2/1996 | Sakai et al. | 206/515 |

*Primary Examiner*—Bryon P. Gehman
*Attorney, Agent, or Firm*—Cary W. Brooks

[57] ABSTRACT

A cable storage container is provided which includes a conical core with a top and a bottom, the bottom having a larger diameter than the top, an annular core base plate joined to the bottom of the core, a conical outer cover, the other cover retaining stored cable between the outer cover and the core, the outer cover having a top and a bottom with the top having a larger diameter than the bottom, and an annular outer cover base plate joined to the outer cover, the outer cover base plate having an opening fitted around the bottom of the core.

7 Claims, 6 Drawing Sheets

CABLE STORAGE CONTAINER

TECHNICAL FIELD

The field of the present invention is that of cable storage containers.

BACKGROUND OF THE INVENTION

Wire cable often must be processed before it can be utilized. One such process is to place an insulating cover on the cable. Often, a facility which installs the insulation on the cable is distant from a facility which processes the cable. For transport, the cable is typically wound into cardboard barrels. The barrels are then placed into a truck and then shipped to the facility which installs terminals on the cable. After being shipped, the cable is then usually placed on a platform and the cable is pulled from the barrel to further process the cable. One form of a prior art container included an octagon shaped cardboard core and shrink wrap type thin plastic on the outside of the cable. Although the core could be collapsed and easily stored and shipped after use, the cable had a tendency to get caught on the eight corners of the octagon shaped core causing tangles and production problems. Further, the cable would shift during shipment causing the cable to be tangled. The shrink wrap thin film plastic provided little protection against damage to the cable during shipment.

Another form of a prior art container included a cylindrical cardboard core and a cylindrical outer barrel surrounding the core. This design also had several drawbacks. First, the cable would catch on the relatively rough surface of the cardboard core and become tangled. Second, the containers were not collapsible or stackable and therefore occupied a substantial amount of space during after use storage or shipment. Third, due to the cylindrical design of the container, the cable was loaded into the barrel container in concentric rings. However, as the cable from an outer ring was pulled during unloading, the outer ring tightened around and became entangled with the inner cable rings. Fourth, the cable also tended to shift and become entangled during shipment.

The present invention provides alternative to and advantages over the prior art.

SUMMARY OF THE INVENTION

The present invention provides a cable storage container having a conical core joined to an annular base plate. Fitted around the core is an outer cover with an inverse conical shape having a base plate joined thereto that sits on top of the base plate joined to the core.

Since the cable container provides this double conical shape, wire tends to pull out of the container with much less chance of encountering snagging. After the cable has been processed from the container, the outer cover can be simply lifted off and the outer covers and cores may be stacked therefore greatly reducing the shipping volume required to return the containers to their original cable producing facility.

Other advantages of the present invention will be apparent to those skilled in the art as the present invention is further explained in the accompanying detailed drawings.

DETAILED DESCRIPTION

Figure 1:
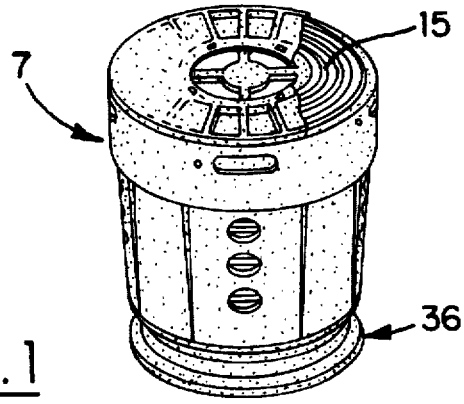
FIG. 1 is a perspective view of a preferred embodiment cable storage container according to the present invention shown being filled with cable and being ready to ship.
Figure 2:
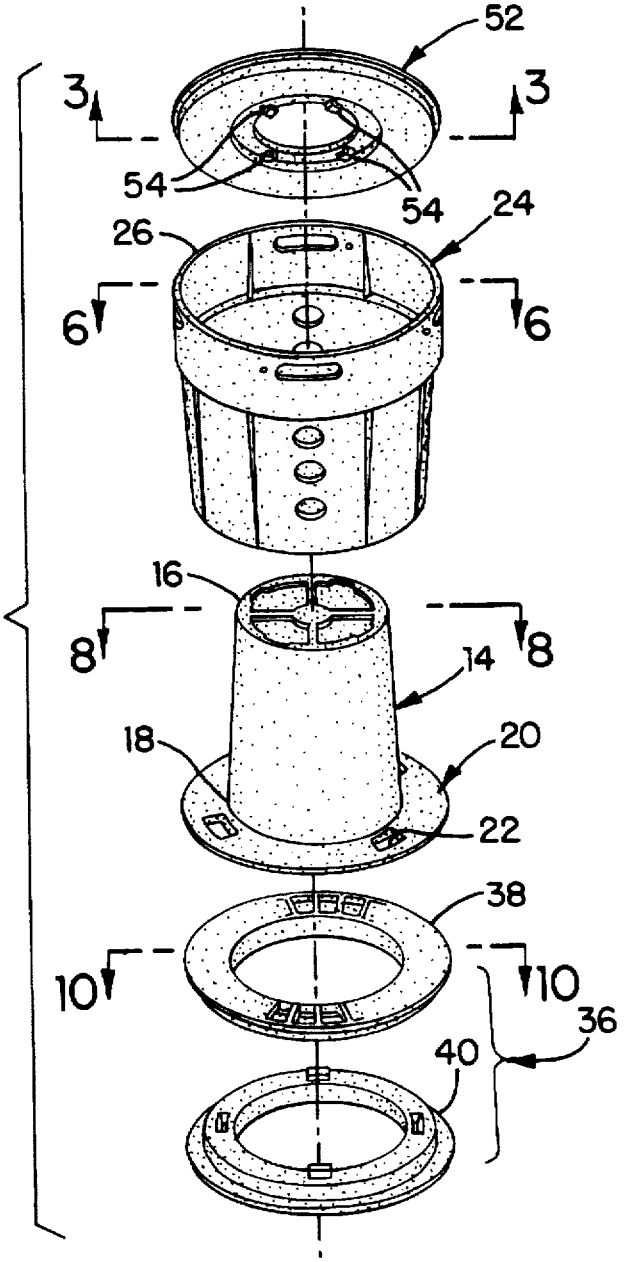
FIG. 2 is an exploded view of the cable storage container shown in FIG. 1.
Figure 7:
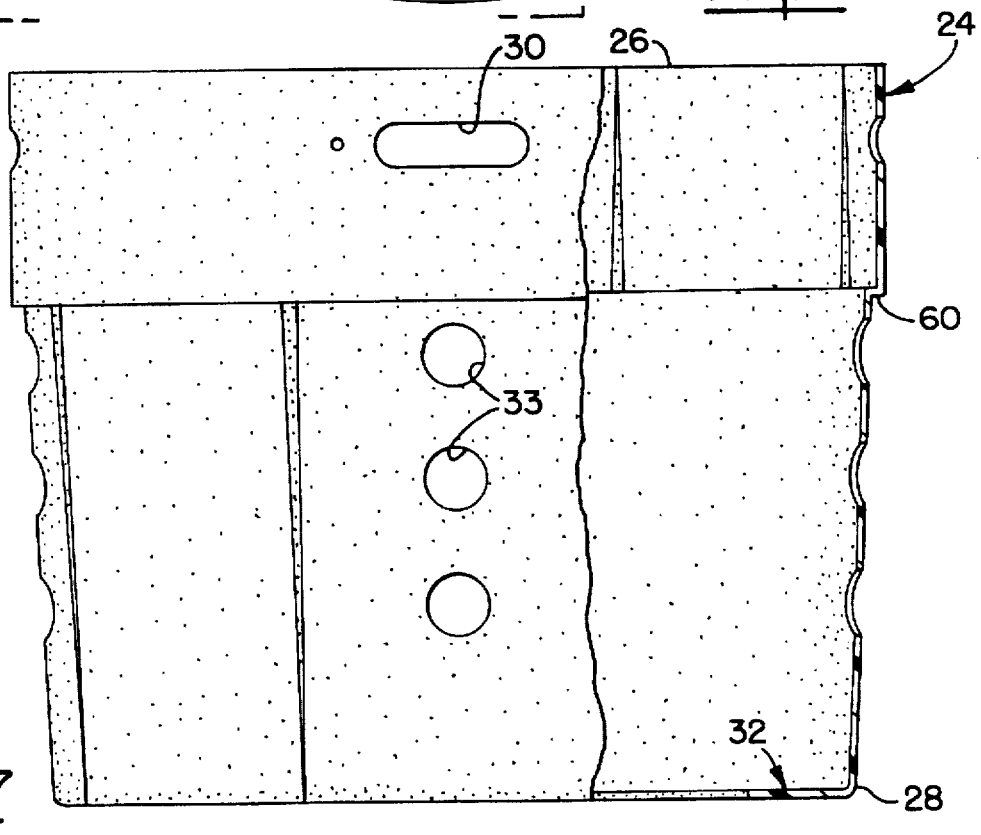
FIG. 7 is a view taken along line 7—7 of FIG. 6.
Figure 8:
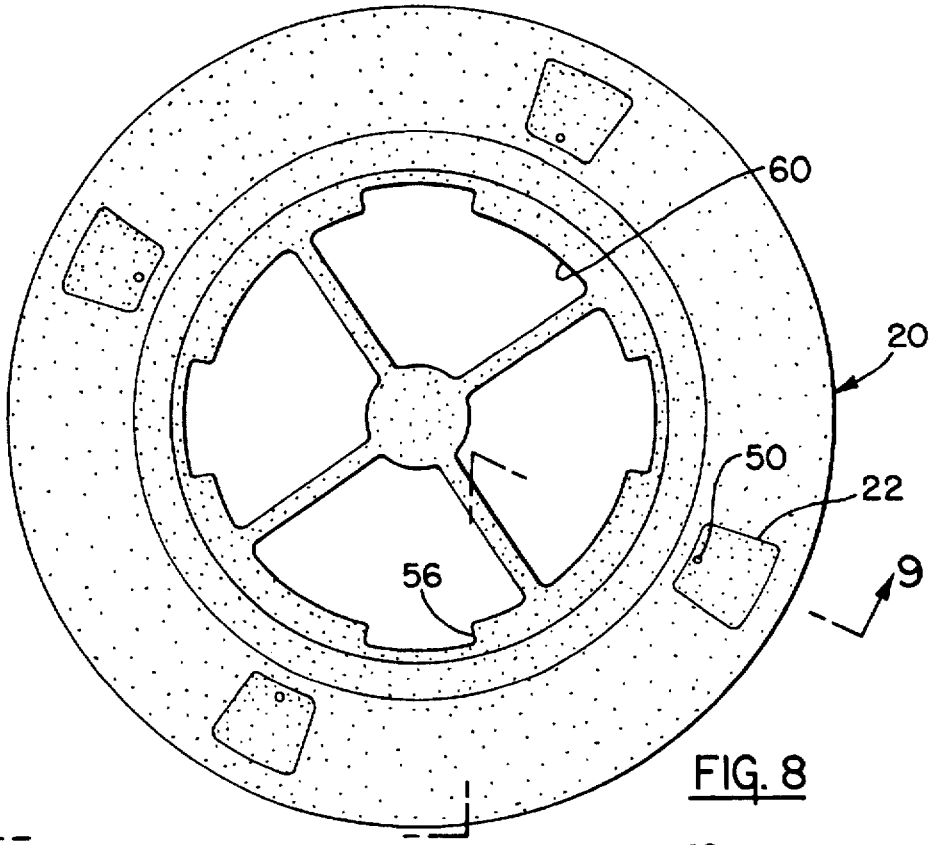
FIG. 8 is a view taken along line 8—8 of FIG. 2.
Figure 9:
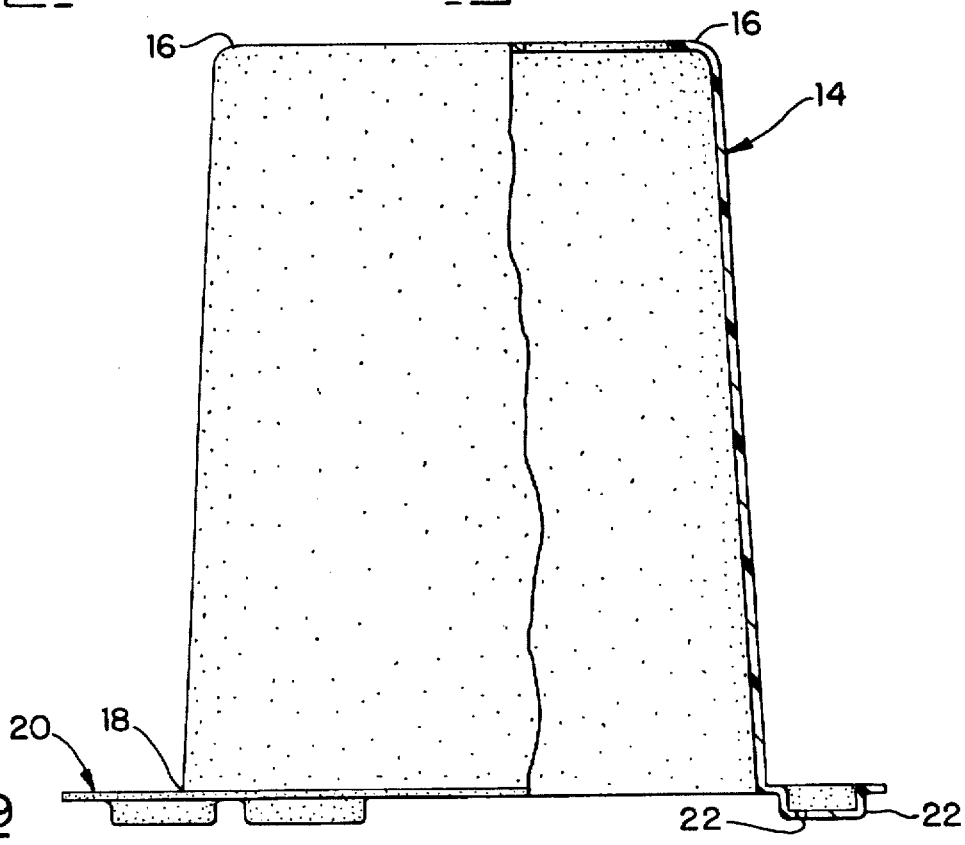
FIG. 9 is a view taken along line 9—9 of FIG. 8.
Figure 10:
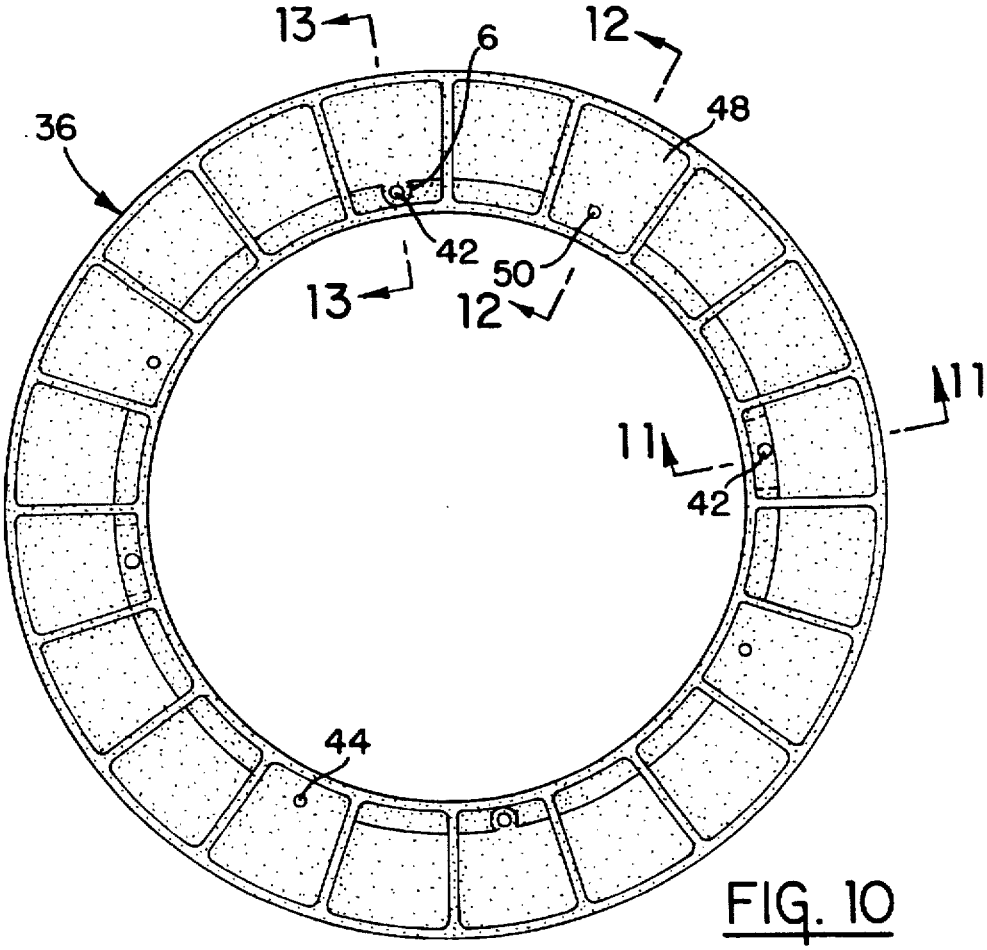
FIG. 10 is a view taken along line 10—10 of FIG. 2.
Figure 11:
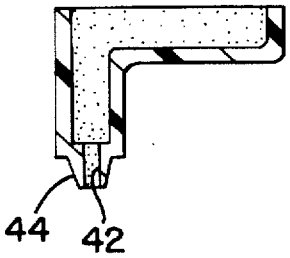
FIGS. 11, 12 and 13 are views taken along lines 11—11, 12—12, and 13—13, respectively, of FIG. 10.
Figure 13:
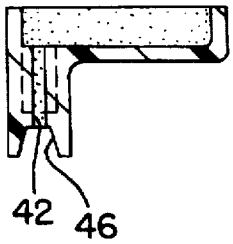
Figure 12:
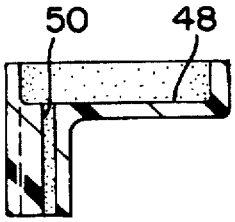

Referring to FIGS. 1 through 14, a preferred embodiment cable storage container 7, as provided by the present invention, has a core 14 (see FIGS. 1, 8 and 9). The core 14 has a top 16 anti a bottom 18 which is larger in diameter than the top 16. The core 14 has a conical shape and will be typically fabricated from a polypropylene or other suitable alternative plastic.

Integrally joined to the core 14 is a core base plate 20. The core base plate 20 has a series of projections 22 which function will be described later.

Figure 6:
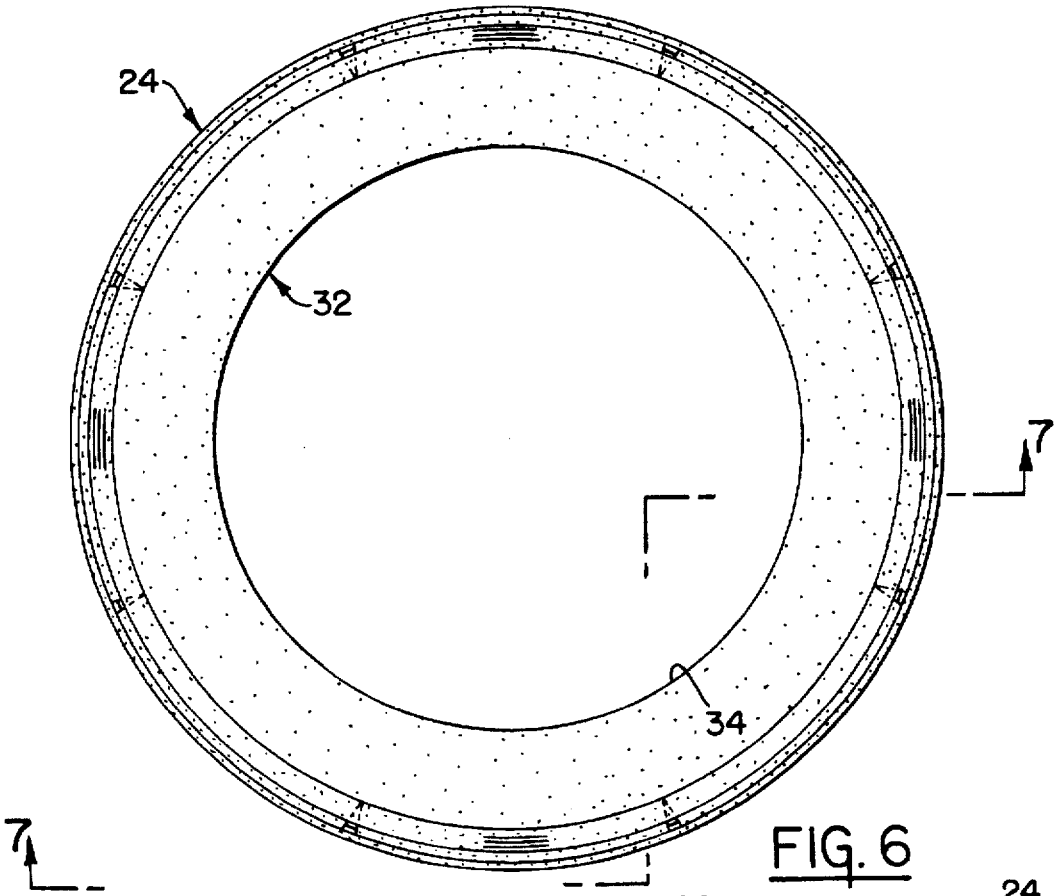
FIG. 6 is a view taken along line 6—6 of FIG. 2.

The container 7 also has an outer cover 24 (see FIGS. 6 and 7). The outer cover 24 has an inverse conical shape with a top 26 which is larger in diameter than a bottom 28. The outer cover 24 is made from a polypropylene or other suitable plastic and has a hand hole 30 and a series of inspection holes 33 to allow for determination of how much cable is within the container 7. The outer cover is relatively thick and ridged to prevent damage to the cable during shipping or handling.

Integrally joined to the outer cover 24 is an outer cover base plate 32 which is annular having an interior opening 34 which is fitted about the core 14. The outer cover base plate 32 is seated on top of the core base plate 20. The outer cover 24 retains cable 15 positioned between the outer cover 24 and the core 14 (FIG. 1).

The core base plate 20 is supported by a palette plate 36 which is assembled from two halves 38 and 40. The palette halves 38 and 40 are substantially similar molded pieces each having fastener holes 42 and one of the halves having a tapered projection 44 which is fitted into a tapered nest 46 of the opposite palette half. (See FIGS. 10, 11 and 13.)

The palette plate halve 38 also has a series of pockets 48 with fastener holes 50 to receive the projections 22 of the core base plate 20. In like manner, the core base plate 20 will have a fastener hole 50 to facilitate the permanent affixation of the core base plate and core with the palette plate 36.

Figure 3:
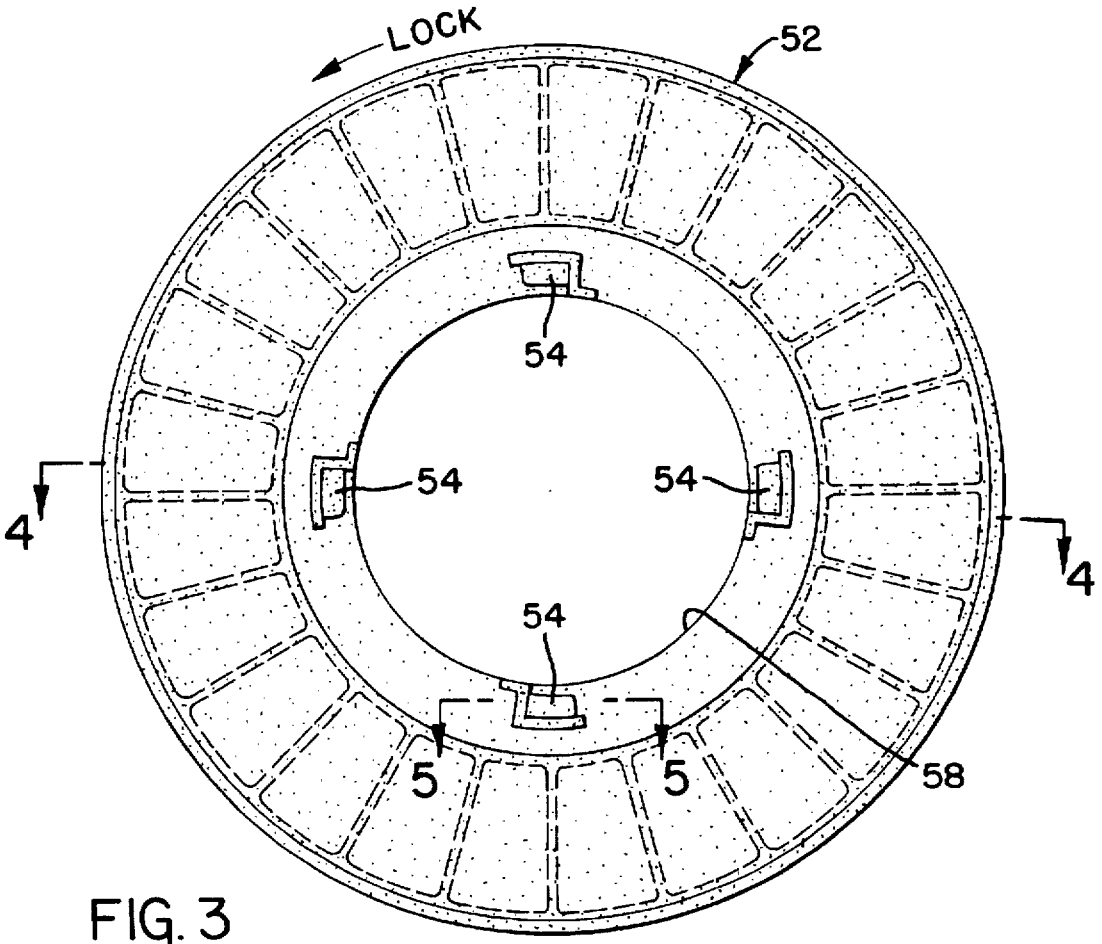
FIG. 3 is a view taken along line 3—3 of FIG. 2.
Figure 4:
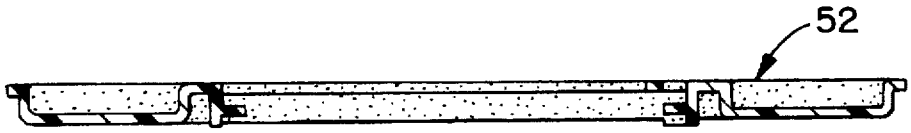
FIG. 4 and FIG. 5 are views taken along line 4—4 and 5—5 of FIG. 3, respectively.
Figure 5:
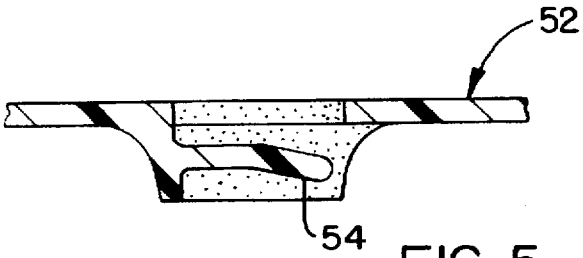

The container 7 also has a top cover 52 (See FIGS. 3, 4, and 5). The top cover 52 has four geometrically spaced twist tabs 54 which interlock with locking edges 56 (FIGS. 2 and 8) provided in the top 16 of the core 14. The top cover 52 has a interior diameter 58 to allow exposure between an interior opening 60 (FIG. 8) of the core top 16. The opening 60 aids in the reduction of warpage and material cost.

Figure 14:
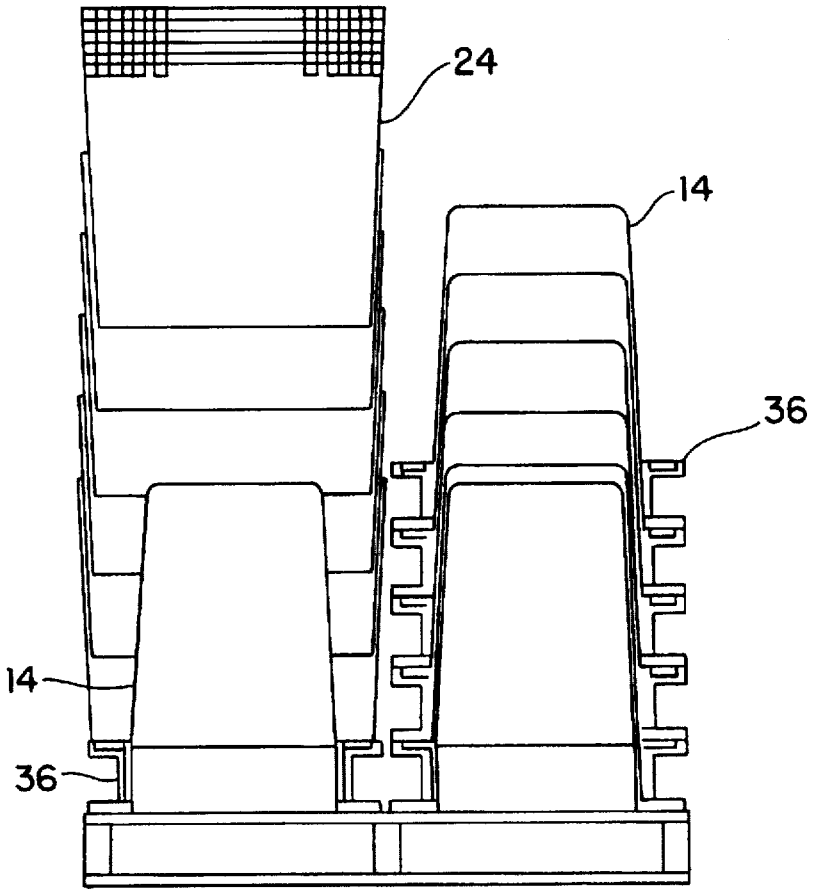
FIG. 14 shows the inventive container stacked for shipping.

Referring to FIG. 14, a series of cores 14 with their attached palette plates 36 are shown in a stacked arrangement for shipment back to the cable producing facility. The outer covers 24 are then stacked one upon another on one of the cores 14. Additionally, the outer covers 24 have along their outer diameter a ledge surface 62 to prevent their wedging together.

Figure 15:
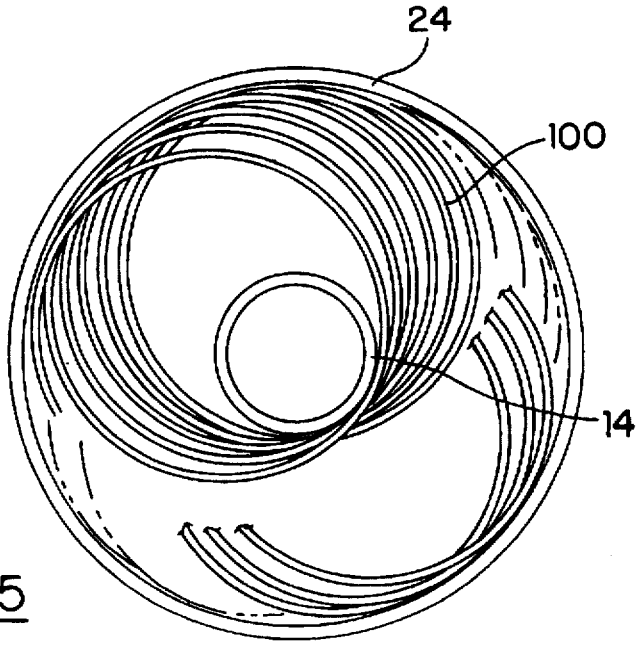
FIG. 15 is of the inventive container illustrating the pedal configuration of the cable.

FIG. 15 is a top view of the inventive container. Due to the tapered core 14 and the inversely tapered outer cover 24 configuration, cable 100 may be loaded into the container in a daisy pedal configuration including slightly overlapping elliptical shaped loops. Loading the cable in a daisy pedal configuration prevents the cable from shifting during shipment and eliminates the problem of tangling caused by an outer ring of cable tightening around an inner ring that use associated with the prior art cylindrical barrel design.

As the cable is loaded in the container, one portion of a cable loop engages and slides down the tapered surface of the core while another portion is relatively free. Consecutive loops are loaded into the barrel so that there is a series of slightly overlapping elliptical loops. These elliptical loops can be unwound without an outer loop tightening around and entangling an inner loop.

As will be appreciated from the foregoing discussion, the present invention provides a cable container that has a relatively thick and rigid outer cover that protects the cable during shipping and handling. The tapered core and inversely tapered outer cover allows for the loading of the cable into the container in overlapping elliptical loops that prevent the cable from shifting during shipment and prevents tangles during unloading of the cable. The plastic core has a smooth tapered surface that prevents the cable from being caught and tangled during unloading. Finally, the outer cover and core components can be easily stacked, stored and shipped after use.

While this invention has been described in terms of a preferred embodiment thereof, it will be appreciated that other forms could be adapted by one skilled in the art. Accordingly, the scope of this invention is to be considered limited only by the following claims

What is claimed is:

1. A cable storage container comprising:

a conical core with a top and a bottom, the bottom having a larger diameter than the top;

an annular core base plate joined to the bottom of the core;

a conical outer cover, the outer cover retaining stored cable between the outer cover and the core, the outer cover having a top and a bottom with the top having a larger diameter than the bottom; and an annular outer cover base plate joined to the outer cover, the outer cover base plate having an opening fitted around the bottom of the core.

2. A cable storage container as described in claim 1 wherein the outer cover base plate is integral with the outer cover.

3. A cable storage container as described in claim 1 wherein the core and core base plate being constructed and arranged so that a plurality of cores and core base plates are stackable one on the other.

4. A cable storage container as described in claim 1 wherein the outer cover and the outer cover base plate being constructed and arranged so that a plurality of outer covers and outer cover base plates are stackable one on another.

5. A cable storage container as described in claim 1 further including a palette plate joined to the core base plate and wherein the palette plate and the core base plate have an interface with one of the plates having a projection fitting into a pocket of the other plate.

6. A cable storage container as described in claim 1 further including a palette plate moldable in halves which can be nested with each other.

7. A cable storage container as described in claim 1 further comprising:

a top cover having a lock connection with the top of the core.

* * * * *